US008374523B2

(12) United States Patent
Kato

(10) Patent No.: US 8,374,523 B2
(45) Date of Patent: Feb. 12, 2013

(54) DEVELOPING CARTRIDGE, PROCESS UNIT, AND IMAGE FORMING APPARATUS

(75) Inventor: Shuichi Kato, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 324 days.

(21) Appl. No.: 12/785,777

(22) Filed: May 24, 2010

(65) Prior Publication Data

US 2011/0076049 A1 Mar. 31, 2011

(30) Foreign Application Priority Data

Sep. 29, 2009 (JP) ..... 2009-224705

(51) Int. Cl.
*G03G 15/00* (2006.01)

(52) U.S. Cl. ..... 399/90; 399/88; 399/119

(58) Field of Classification Search ..... 399/90, 399/119

See application file for complete search history.

(56) References Cited

U.S. PATENT DOCUMENTS

| | | | | |
|---|---|---|---|---|
| 7,986,897 | B2 | 7/2011 | Nishimura | |
| 2004/0028424 | A1 | 2/2004 | Yokoi | |
| 2008/0212996 | A1 | 9/2008 | Yokoi | |
| 2008/0317499 | A1 | 12/2008 | Nishimura | |
| 2009/0169256 | A1 | 7/2009 | Kamimura et al. | |
| 2011/0236051 | A1* | 9/2011 | Kato | 399/90 |

FOREIGN PATENT DOCUMENTS

| | | |
|---|---|---|
| JP | 2000-298398 | 10/2000 |
| JP | 2004-077565 | 3/2004 |
| JP | 2009-003174 | 1/2009 |
| JP | 2009-162908 | 7/2009 |

OTHER PUBLICATIONS

Official Action dated Aug. 30, 2011 received from the Japanese Patent Office from related Japanese Application No. 2009-224705, together with an English-language translation.

* cited by examiner

*Primary Examiner* — Walter L Lindsay, Jr.
*Assistant Examiner* — Benjamin Schmitt
(74) *Attorney, Agent, or Firm* — Scully, Scott, Murphy & Presser, PC

(57) ABSTRACT

A developing cartridge includes a frame, a developer carrying member, a developer supplying member, and an electrode member. The developer carrying member has a first rotational axis defining an axial direction. The developer supplying member has a second rotational axis parallel to the first rotational axis. Both of the first rotational axis and the second rotational axis lie in a first plane. The electrode member is provided on the frame, and configured to receive an electrical power from an external power supplying member. The electrode member has a contact portion that is configured to contact with the external power supplying member. The contact portion has a linear shape and lies in an imaginary plane that extends parallel to the first rotational axis. The first plane intersects with the imaginary plane at an angle between 45 degrees and 90 degrees.

7 Claims, 6 Drawing Sheets

DEVELOPING CARTRIDGE, PROCESS UNIT, AND IMAGE FORMING APPARATUS

CROSS REFERENCE TO RELATED APPLICATION

This application claims priority from Japanese Patent Application No. 2009-224705 filed Sep. 29, 2009. The entire content of the priority application is incorporated herein by reference.

TECHNICAL FIELD

The present invention relates to an image forming apparatus such as a color laser printer. The invention also relates to a process unit and a developing cartridge mounted in the process unit for use in the image forming apparatus.

BACKGROUND

One electrophotographic color printer well known in the art is a tandem type color laser printer equipped with four photosensitive drums and four developing cartridges. The photosensitive drums are juxtaposed corresponding to each color of yellow, magenta, cyan, and black. Each of the developing cartridges supplies toner to the corresponding photosensitive drum.

As a developing cartridge provided in such a tandem type color laser printer, there has been proposed a developing cartridge including a developing roller and a supply roller that is in contact with the developing roller. When the developing cartridge is mounted in a drum cartridge in which the photosensitive drum is rotatably supported, the developing cartridge is pressed against a photosensitive drum so that the developing roller is in pressure contact with the photosensitive drum.

Such a conventional developing cartridge includes a bias electrode that is brought into contact with a relay electrode provided at the drum cartridge when the developing cartridge is mounted in the drum cartridge. Bias voltage applied by a high-voltage power supply provided at a main casing of the printer is applied to the bias electrode of the developing cartridge via the relay electrode of the drum cartridge.

SUMMARY

In the conventional developing cartridge, the bias electrode is formed of leaf spring. The bias electrode has a protruding portion that protrudes outwardly in a widthwise direction of the developing cartridge from a right side wall of the developing cartridge. The protruding portion of the bias electrode is bent into a curved shape, and a ridge line thereof is arranged substantially parallel to a direction from the developing roller to the photosensitive drum.

With this configuration, in order to bring the entire ridge line of the protruding portion of the bias electrode into contact with the relay electrode of the drum cartridge, it is necessary to provide the relay electrode having a width greater than that of the bias electrode in the direction from the developing roller to the photosensitive drum. Therefore, it is difficult to downsize the relay electrode in the direction from the developing roller to the photosensitive drum.

In case the developing cartridge is placed into contact with or separated from the drum cartridge, the relay electrode of the drum cartridge might be larger in size in a direction that the developing cartridge is brought into contact with or separated from the photosensitive drum, in response to such movement of the developing cartridge.

In particular, when the direction from the developing roller to the photosensitive drum is equivalent to the direction that the developing cartridge is brought into contact with or separated from the photosensitive drum, the relay electrode may increase in size in this direction.

If the relay electrode increases in size, the relay electrode may interfere the developing cartridge when the developing cartridge is mounted in or removed from the drum cartridge. Hence, the mounting operation of the developing cartridge in the drum cartridge is likely to be deteriorated.

In view of the foregoing, it is an object of the present invention to provide a developing cartridge, a process unit in which the developing cartridge is mounted, and an image forming apparatus in which the process unit is mounted, in order to improve the mounting operation of the developing cartridge in the process unit.

In order to attain the above and other objects, the present invention provides a developing cartridge including a frame, a developer carrying member, a developer supplying member, and an electrode member. The developer carrying member is rotatably supported on the frame and carries a developer. The developer carrying member has a first rotational axis defining an axial direction. The developer supplying member is rotatably supported on the frame and contacts the developer carrying member to supply the developer to the developer carrying member. The developer supplying member has a second rotational axis parallel to the first rotational axis. Both of the first rotational axis and the second rotational axis lie in a first plane. The electrode member is provided on the frame, and configured to receive an electrical power from an external power supplying member. The electrode member has a contact portion that is configured to contact with the external power supplying member. The contact portion has a linear shape and lies in an imaginary plane that extends parallel to the first rotational axis. The first plane intersects with the imaginary plane at an angle between 45 degrees and 90 degrees.

According to another aspect, the present invention provides a process unit including: a process frame that is slidingly movable relative to the main casing of an image forming apparatus; and a developing cartridge that is detachable from or attachable to the process frame. The developing cartridge includes a frame, a developer carrying member, a developer supplying member, and an electrode member. The developer carrying member is rotatably supported on the frame and carries a developer. The developer carrying member has a first rotational axis defining an axial direction. The developer supplying member is rotatably supported on the frame and contacts the developer carrying member to supply the developer to the developer carrying member. The developer supplying member has a second rotational axis parallel to the first rotational axis. Both of the first rotational axis and the second rotational axis lies in a first plane. The electrode member is provided on the frame, and configured to receive an electrical power from an external power supplying member. The electrode member has a contact portion that is configured to contact with the external power supplying member. The contact portion has a linear shape and lies in an imaginary plane that extends parallel to the first rotational axis. The first plane intersects with the imaginary plane at an angle between 45 degrees and 90 degrees.

According to another aspect, the present invention provides a image forming apparatus including a main casing and a process unit that is accommodated in the main casing. The process unit includes a process frame that is slidingly movable relative to the main casing; and a developing cartridge that is detachable from or attachable to the process frame. The developing cartridge includes a frame, a developer carrying member, a developer supplying member, and an electrode member. The developer carrying member is rotatably supported on the frame and carries a developer. The developer carrying member has a first rotational axis defining an axial direction. The developer supplying member is rotatably supported on the frame and contacts the developer carrying member to supply the developer to the developer carrying member. The developer supplying member has a second rotational axis parallel to the first rotational axis. Both of the first rotational axis and the second rotational axis lie in a first plane. The electrode member is provided on the frame, and configured to receive an electrical power from an external power supplying member. The electrode member has a contact portion that is configured to contact with the external power supplying member. The contact portion has a linear shape and lies in an imaginary plane that extends parallel to the first rotational axis. The first plane intersects with the imaginary plane at an angle between 45 degrees and 90 degrees.

BRIEF DESCRIPTION OF THE DRAWINGS

The particular features and advantages of the present invention as well as other objects will become apparent from the following description taken in connection with the accompanying drawings, in which.

DETAILED DESCRIPTION

1. Overall Structure of Color Laser Printer

A color laser printer as an image forming apparatus according to one embodiment of the present invention will be described while referring to the accompanying drawings.

Figure 1:
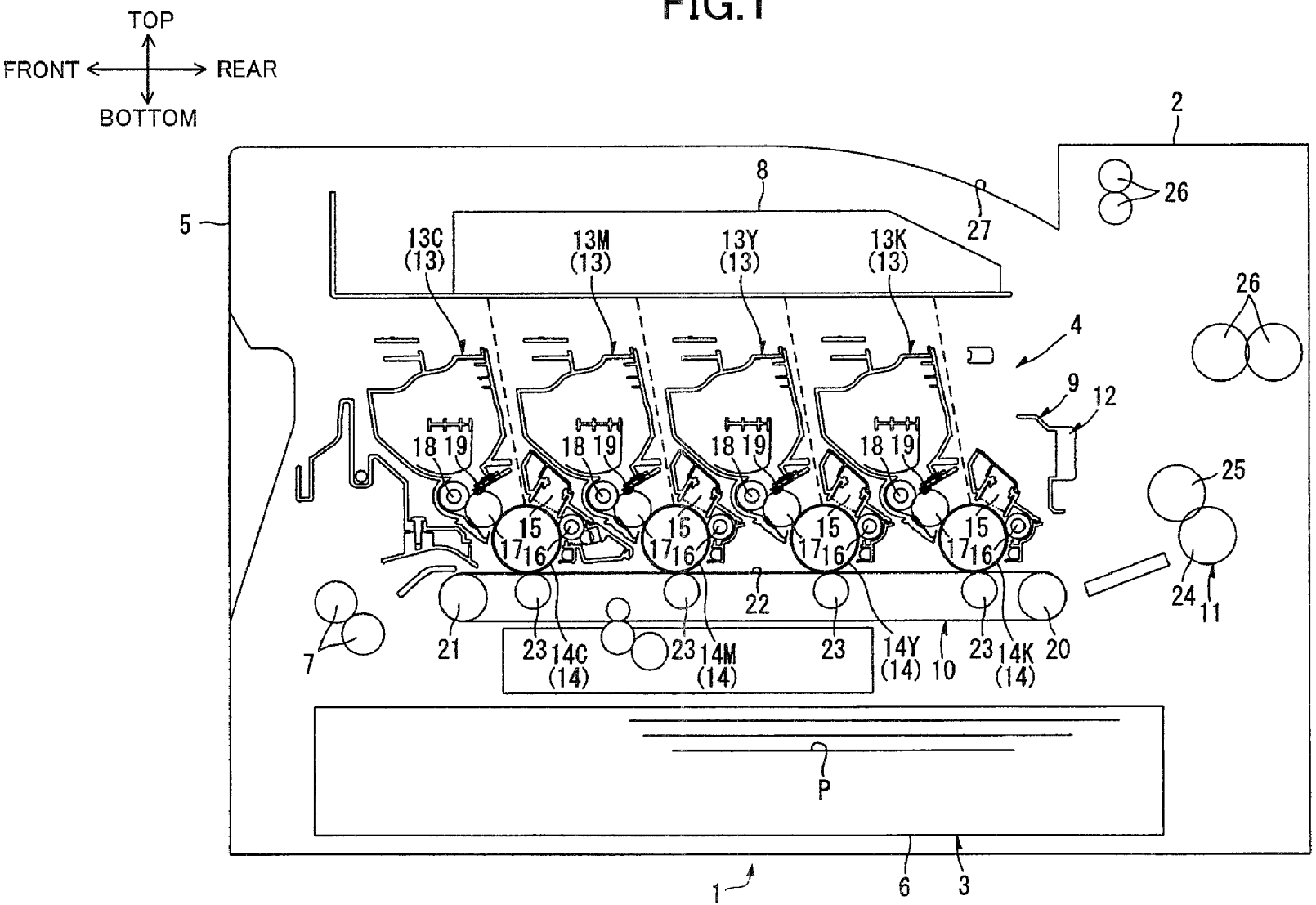
FIG. 1 is a color laser printer as an image forming apparatus according to an embodiment of the present invention.

As shown in FIG. 1, the color laser printer 1 is a horizontal direct tandem type color laser printer. The color laser printer 1 includes a main casing 2 and, within the main casing 2, a feeding unit 3 for feeding a sheet of paper P and an image forming unit 4 for forming an image on the sheet P conveyed from the feeding unit 3.

(1) Main Casing

The main casing 2 has a box shape that is substantially rectangular in a side view. The feeding unit 3 and the image forming unit 4 are accommodated in the main casing 2. The main casing 2 has a front wall at which a front cover 5 is provided. The front cover 5 is pivotally movable about its lower end relative to the main casing 2. Through the front cover 5, a process unit 9 (described later) is mounted in or removed from the main casing 2.

In the following description, a side of the color laser printer 1 on which the front cover 5 is provided (left side in FIG. 1) will be referred to as the front side, and the opposite side (right side in FIG. 1) as the rear side. The left and right sides of the color laser printer 1 will be based on the perspective of a user viewing the color laser printer 1 from the front. Hence, the near side of the color laser printer 1 in FIG. 1 is the right side, and the far side is the left side.

(2) Feeding Unit

The feeding unit 3 includes a paper try 6 for accommodating the sheet P. The paper try 6 is detachably mounted in a bottom section of the main casing 2. A pair of registration rollers 7 is provided at a position upward of a front end portion of the paper try 6.

Each sheet P accommodated in the paper try 6 is conveyed toward a position between the registration rollers 7. The sheet P is subsequently conveyed toward the image forming unit 4 so as to pass between four photosensitive drums 14 (described later) and a conveying belt 22.

(3) Image Forming Unit

The image forming unit 4 includes a scanning unit 8, the process unit 9, a transfer unit 10, and a fixing unit 11.

(3-1) Scanning Unit

The scanning unit 8 is disposed in a top section of the main casing 2. As indicated by broken lines in FIG. 1, the scanning unit 8 irradiates laser beams toward four photosensitive drums 14 (described later) based on image data in order to expose the photosensitive drums 14.

(3-2) Process Unit (3-2-1) Structure of Process Unit

The process unit 9 is disposed below the scanning unit 8 and above the transfer unit 10. The process unit 9 includes a single process frame 12 (see also FIGS. 2 and 3), and four developing cartridges 13 provided respectively for each of four colors.

The process frame 12 integrally supports the four developing cartridge 13, the photosensitive drums 14, Scorotron chargers 15, and drum cleaning rollers 16. The process frame 12 is slidingly movable relative to the main casing 2 in the front-to-rear direction. Hence, the process unit 9 is slidingly movable relative to the main casing 2 in a front-to-rear direction and, thus, can be detachable from or attachable to the main casing 2 through the front cover 5.

Four of the photosensitive drums 14 are arranged parallel to and spaced apart from one another in the front-to-rear direction, and oriented with their axes along a left-to-right direction. Specifically, the photosensitive drums 14 include a black photosensitive drum 14K, a yellow photosensitive drum 14Y, a magenta photosensitive drum 14M, and a cyan photosensitive drum 14C arranged in this order from rear to front.

The Scorotron chargers 15 are disposed diagonally above and rearward of the respective photosensitive drums 14, and confront but do not contact the photosensitive drums 14.

The drum cleaning rollers 16 are disposed rearward of the respective photosensitive drums 14, and contact the photosensitive drums 14.

The developing cartridges 13 are detachably mounted in the process frame 12 in a juxtaposed state above the corresponding photosensitive drums 14. Specifically, the developing cartridges 13 include a black developing cartridge 13K, a yellow developing cartridge 13Y, a magenta developing cartridge 13M, and a cyan developing cartridge 13C arranged in this order from rear to front.

Further, each of the developing cartridges 13 is provided with a developing roller 17 as an example of a developer carrying member, a supply roller 18 as an example of a developer supplying member, and a thickness-regulating blade 19. Each developing roller 17 is rotatably supported on a lower end portion of the corresponding developing cartridge 13. The developing roller 17 has a bottom rear portion that is exposed through a rear opening of the developing cartridge 13 and contacts the corresponding photosensitive drum 14 from above. The developing roller 17 will be described later in detail.

Each of the supply rollers 18 supplies toner to the corresponding developing roller 17. Each of the thickness-regulating blades 19 regulates the thickness of the toner supplied to the developing roller 17. The developing cartridge 13 accommodates toner, as an example of a developer, for a corresponding color in a space formed above the supply roller 18 and the thickness-regulating blade 19.

(3-2-2) Developing Operations of Process Unit

The toner accommodated in each developing cartridge 13 is supplied onto the corresponding supply roller 18, which in turn supplies the toner to the developing roller 17. The toner is positively tribocharged between the supply roller 18 and the developing roller 17.

In association with rotation of the developing roller 17, the thickness-regulating blade 19 regulates the toner carried on a surface of the developing roller 17 to a prescribed thickness, so that the developing roller 17 carries a uniform thin layer of the toner thereon.

In the meantime, the Scorotron charger 15 applies a uniform charge of positive polarity to a surface of the photosensitive drum 14 in association with rotation of the photosensitive drum 14. Subsequently, the scanning unit 8 irradiates the laser beam (indicated by the broken line in FIG. 1) in a high-speed scan in order to expose the surface of the photosensitive drum 14. Hence, an electrostatic latent image is formed on the surface of the photosensitive drum 14 corresponding to an image to be formed on the sheet P.

As the photosensitive drum 14 continues to rotate, the positively charged toner carried on the surface of the developing roller 17 is supplied to the electrostatic latent image formed on the surface of the photosensitive drum 14, thereby developing the electrostatic latent image into a visible toner image through reverse development.

(3-3) Transfer Unit

The transfer unit 10 is disposed in the main casing 2 above the feeding unit 3 and below the process unit 9, and extends in the front-to-rear direction. The transfer unit 10 includes a drive roller 20, a driven roller 21, the conveying belt 22, and four transfer rollers 23.

The drive roller 20 and the driven roller 21 are disposed parallel to each other and are separated in the front-to-rear direction. The conveying belt 22 is stretched around the drive roller 20 and the driven roller 21, with an upper section of the conveying belt 22 opposing and contacting each of the photosensitive drums 14 from below. When the drive roller 20 is driven to rotate, the conveying belt 22 circulates such that the top portion of the conveying belt 22 in contact with the photosensitive drums 14 moves rearward from the front side.

The transfer rollers 23 are disposed inside the conveying belt 22 at positions opposing corresponding photosensitive drums 14, with the upper section of the conveying belt 22 interposed therebetween. The positions between the transfer rollers 23 and respective photosensitive drums 14 will be referred to as transfer positions.

When the sheet P is supplied from the feeding unit 3, the conveying belt 22 conveys the sheet P rearward so that the sheet P passes sequentially through each transfer position. As the sheet is conveyed on the conveying belt 22, toner images in each color carried on the respective photosensitive drums 14 are sequentially transferred onto the sheet P to form a color image.

In some cases, residual toner remains on a peripheral surface of the photosensitive drum 14 after the toner image has been transferred onto the sheet P from the photosensitive drum 14. When the residual toner is brought opposite the drum cleaning roller 16 in association with rotation of the photosensitive drum 14, the residual waste toner is transferred onto a peripheral surface of the drum cleaning roller 16 owing to a cleaning bias applied to the drum cleaning roller 16 and is temporarily retained on the drum cleaning roller 16.

(3-4) Fixing Unit

The fixing unit 11 is disposed rearward of the transfer unit 10. The fixing unit 11 includes a heating roller 24, and a pressure roller 25 in confrontation with the heating roller 24. After the color image has been transferred onto the sheet P in the transfer unit 10, the color image is thermally fixed onto the sheet P by a combination of heat and pressure while the sheet P passes between the heating roller 24 and the pressure roller 25 in the fixing unit 11.

(4) Discharge Section

After the toner image has been fixed onto the sheet P, the sheet P is conveyed so as to pass a U-shaped discharge path (not shown) by each pair of discharge rollers 26. The discharge rollers 26 discharge the sheet P onto a discharge tray 27 disposed above the scanning unit 8.

2. Detailed Description of Process Unit (1) Process Frame

Figure 2:
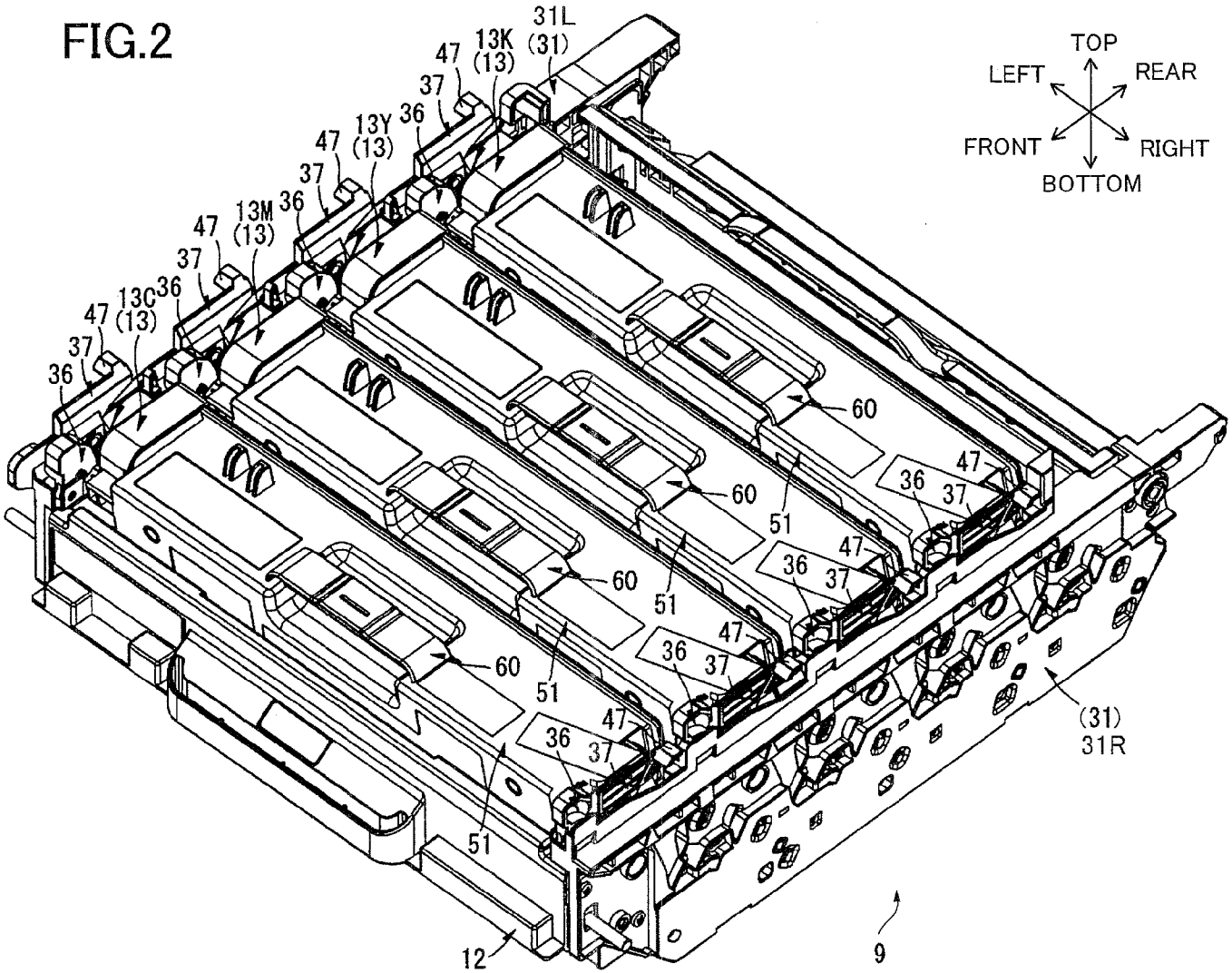
FIG. 2 is a perspective view of a process unit shown in FIG. 1, as viewed from an upper right side thereof.

As shown in FIG. 2, the process frame 12 has a substantially rectangular frame shape in a plan view and elongated in the front-to-rear direction. The process frame 12 is provided with a pair of left and right side plates 31.

Figure 3:
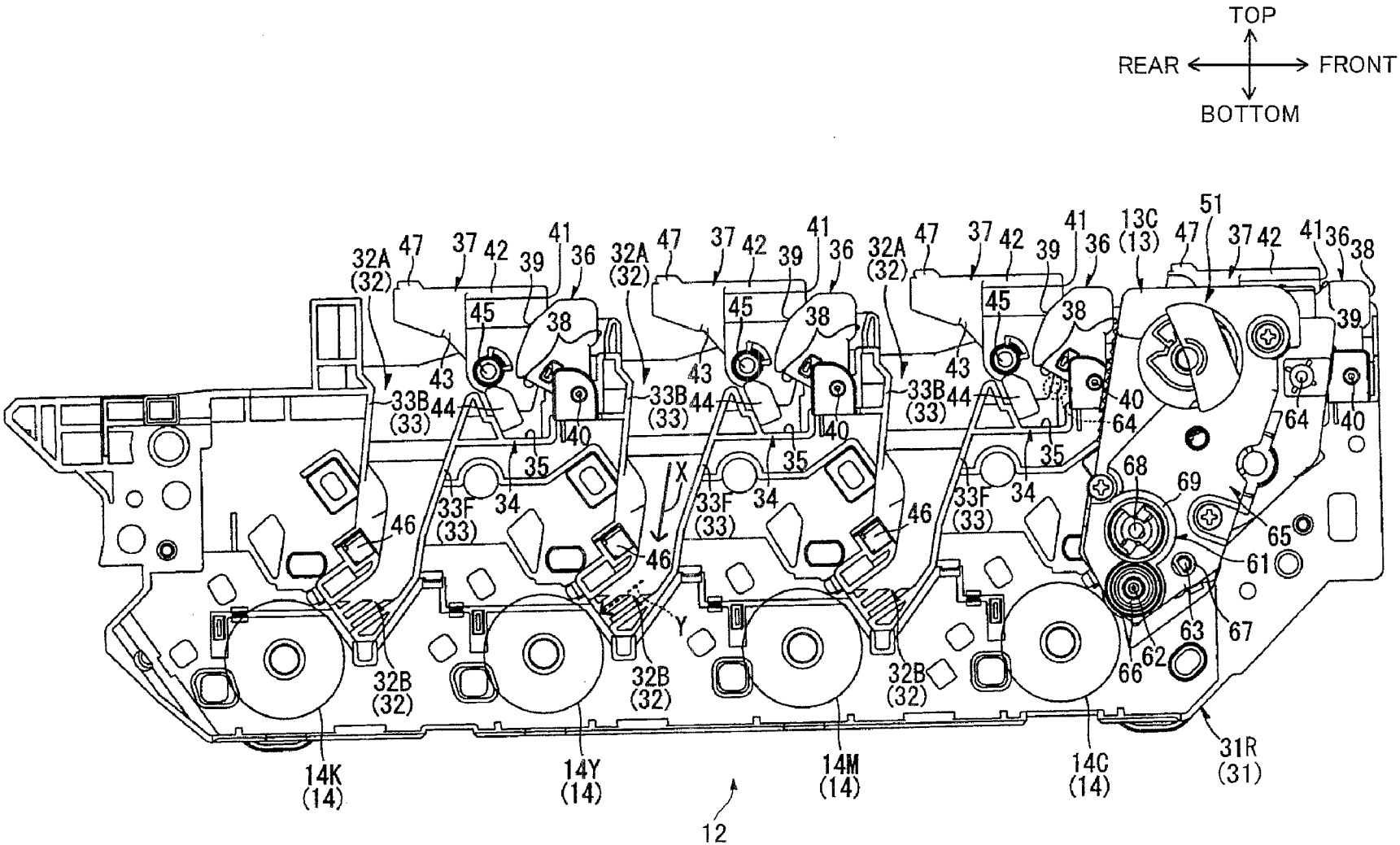
FIG. 3 is a left side view of a process frame shown in FIG. 2, showing a right side plate thereof.

The side plates 31 are arranged in confrontation with and spaced apart from each other in the left-to-right direction. Each of the side plate 31 is formed in a substantially rectangular shape and elongated in the front-to-rear direction. As shown in FIG. 3, each of the side plates 31 is formed with four guide grooves 32 at an inner surface thereof.

Hereinafter, the side plate 31 on the right side will be referred to as the right side plate 31R, and the side plate 31 on the left side will be referred to as the left side plate 31L when it is necessary to distinguish between the two. In the present embodiment, a process-frame electrode 46 (described later) is only provided at the right side plate 31R. In the following description, the right side plate 31R at which the process-frame electrode 46 is provided will be described in detail, and description of the left side plate 31L will be omitted.

The four guide grooves 32 are formed in a left surface (the inner surface in the left-to-right direction) of the right side plate 31R. The guide grooves 32 are arranged equally spaced apart from one another in the front-to-rear direction. The guide grooves 32 are located below an upper edge of the right side plate 31R and above the photosensitive drums 14. That is, each of the guide groove 32 extends from the upper edge of the right side plate 31R toward the corresponding photosensitive drum 14 in a direction diagonally below and rearward (hereinafter referred to as a first direction X, and the first direction X is indicated by a bold solid arrow in FIG. 3).

Four sets of a pair of guide ribs 33 corresponding to the four guide grooves 32 are provided in the left surface of the right side plate 31R so as to define the corresponding guide grooves 32.

Hereinafter, one guide rib 33 on the front side in each set of the pair of guide ribs 33 will be referred to as a front rib 33F, and the other guide rib 33 on the rear side in each set of the pair of guide ribs 33 will be referred to as a back rib 33B when it is necessary to distinguish between the two.

The pair of the guide ribs 33 (the front rib 33F and the back rib 33B) is arranged spaced apart from each other in the front-to-rear direction and extends in the first direction X. The guide ribs 33 are formed so as to protrude inwardly (leftward) in the left-to-right direction. The guide ribs 33 have lower ends that are arranged in confrontation with and slightly spaced apart from the photosensitive drum 14.

The front rib 33F has an upper portion extending substantially linearly along the first direction X from the upper edge of the right side plate 31R, while a lower portion thereof is bent rearward and extends in a direction along a radial direction of the photosensitive drum 14 (hereinafter referred to as a second direction Y, and the second direction Y is indicated by a bold dashed arrow in FIG. 3).

The back rib 33B has an upper portion extending substantially linearly along the first direction X from the upper edge of the right side plate 31R, while a middle portion thereof protrudes frontward so as to narrow the width of the guide groove 32 (the distance between the front rib 33F and the back rib 33B in the front-to-rear direction).

A lower portion of the back rib 33B extends along the second direction Y, and is arranged in confrontation with the lower portion of the front rib 33F. The lower portion of the back rib 33B is arranged spaced apart from the lower portion of the front rib 33F with a distance that is substantially equivalent to a diameter of a developing roller shaft 62 (described later).

Each of the guide grooves 32 has a first guide groove 32A and a second guide groove 32B. The first guide groove 32A extends in the first direction X from the upper edge of the right side plate 31R. The second guide groove 32B is continuous with the first guide groove 32A and extends in the second direction Y from a lower end section of the first guide groove 32A.

The middle portion of the back rib 33B is provided with the process-frame electrode 46 as an example of an external power supplying member.

The process-frame electrode 46 is so configured as to expose from the left surface of the right side plate 31R to the atmosphere and the exposed portion thereof has a generally rectangular shape.

The exposed portion of the process-frame electrode 46 has a length in the second direction Y that corresponds to a moving distance of the developing cartridge 13 with respect to the photosensitive drum 14. The moving distance of the developing cartridge 13 corresponds to a distance between a contact position when the developing cartridge 13 is brought into contact with the photosensitive drum 14 and a separated position when the developing cartridge 13 is separated from the photosensitive drum 14 (described later).

That is, the exposed portion of the process-frame electrode 46 has the length in the second direction Y such that the exposed portion of the process-frame electrode 46 constantly contacts an entire portion of a contact portion 70 (described later) of an electrode plate 54 (described later) of the developing cartridge 13 when the developing cartridge 13 is brought into contact with the photosensitive drum 14, and even when the developing cartridges 13 is separated from the photosensitive drum 14 (described later).

The process-frame electrode 46 is provided integrally with a power receiving unit (not shown) that is exposed from a right surface (outer surface) of the right side plate 31R. When the process unit 9 is mounted in the main casing 2, the power receiving unit is electrically connected to a power source (not shown) provided at the main casing 2.

The left surface of the right side plate 31R has an extending portion 34 disposed between the two adjacent guide grooves 32. The extending portion 34 extends in the front-to-rear direction, and connects an upper edge of the front rib 33F defining a front part of the guide groove 32 to an upper edge of the back rib 33B defining a rear part of the guide groove 32. The extending portion 34 has an upper surface with which a concave portion 35 having an open top is formed.

Four pressing cams 36 and four separating cams 37 are provided above the corresponding extending portions 34 in the left surface of the right side plate 31R. Each of the pressing cams 36 and each of the separating cams 37 are provided on the front side of the corresponding guide groove 32 in the right side plate 31R.

The pressing cam 36 is formed in a substantially sector shape in a side view. More specifically, the pressing cam 36 has a pair of flat portions 38, and an arcuate portion 39. The flat portions 38 are arranged such that a distance between each of the flat portions 38 is gradually increased upward and rearward. The arcuate portion 39 is connected a rear end of the rear flat portions 38 and an upper end of the front flat portion 38. The arcuate portion 39 protrudes upward and rearward.

The pressing cam 36 is attached to a pivot shaft 40 extending in the left-to-right direction. The pivot shaft 40 is disposed in the vicinity of a position where lower ends of the flat portions 38 are connected to each other. The pivot shaft 40 is supported on the left surface of the right side plate 31R. The pressing cam 36 is pivotally movable about the pivot shaft 40. Further, the pressing cam 36 is constantly urged by an urging member (not shown) in a counterclockwise direction in a left side view.

Each of the separating cams 37 is disposed rightward and rearward of the corresponding pressing cam 36 and spaced apart from the corresponding pressing cam 36. The separating cam 37 is formed in a generally right-angled triangle shape in a side view. The separating cam 37 has a vertical portion 41, a horizontal portion 42, and a slant portion 43. The vertical portion 41 extends substantially vertically. The horizontal portion 42 extends substantially horizontally from an upper end of the vertical portion 41 rearward. The vertical portion 41 forms a right angle with the horizontal portion 42. The horizontal portion 42 has a rear end from which the slant portion 43 continuously extends diagonally below and frontward. The slant portion 43 is connected to a lower end of the vertical portion 41. The horizontal portion 42 is positioned above the upper edge of the right side plate 31R, as illustrated in FIGS. 2 and 3.

The slant portion 43 is integrally provided with a separating portion 44 at a lower end of the slant portion 43. The separating portion 44 protrudes leftward (inward in the left-to-right direction) from the separating cam 37. The separating portion 44 is formed in a generally trapezoidal shape in a side view, that is, a generally rectangular shape of which an upper front portion is cutout. The separating portion 44 is arranged in confrontation with the pressing cam 36 in the front-to-rear direction.

The rear end of the horizontal portion 42 is integrally provided with a protruding portion 47 protruding upward and rightward (outward), as illustrated in FIG. 2.

The separating cam 37 is attached to a pivot shaft 45 extending in the left-to-right direction. The pivot shaft 45 is disposed above the separating portion 44 of the slant portion 43. The pivot shaft 45 is supported on the left surface of the right side plate 31R. The separating cam 37 is pivotally movable about the pivot shaft 45. The separating cam 37 is constantly urged by an urging member (not shown) in a clockwise direction in a left side view.

A lower end portion of the arcuate portion 39 of the pressing cam 36 confronts but do not contact a front surface of the separating portion 44 of the separating cam 37 in the front-to-rear direction.

(2) Developing Cartridge

Figure 4:
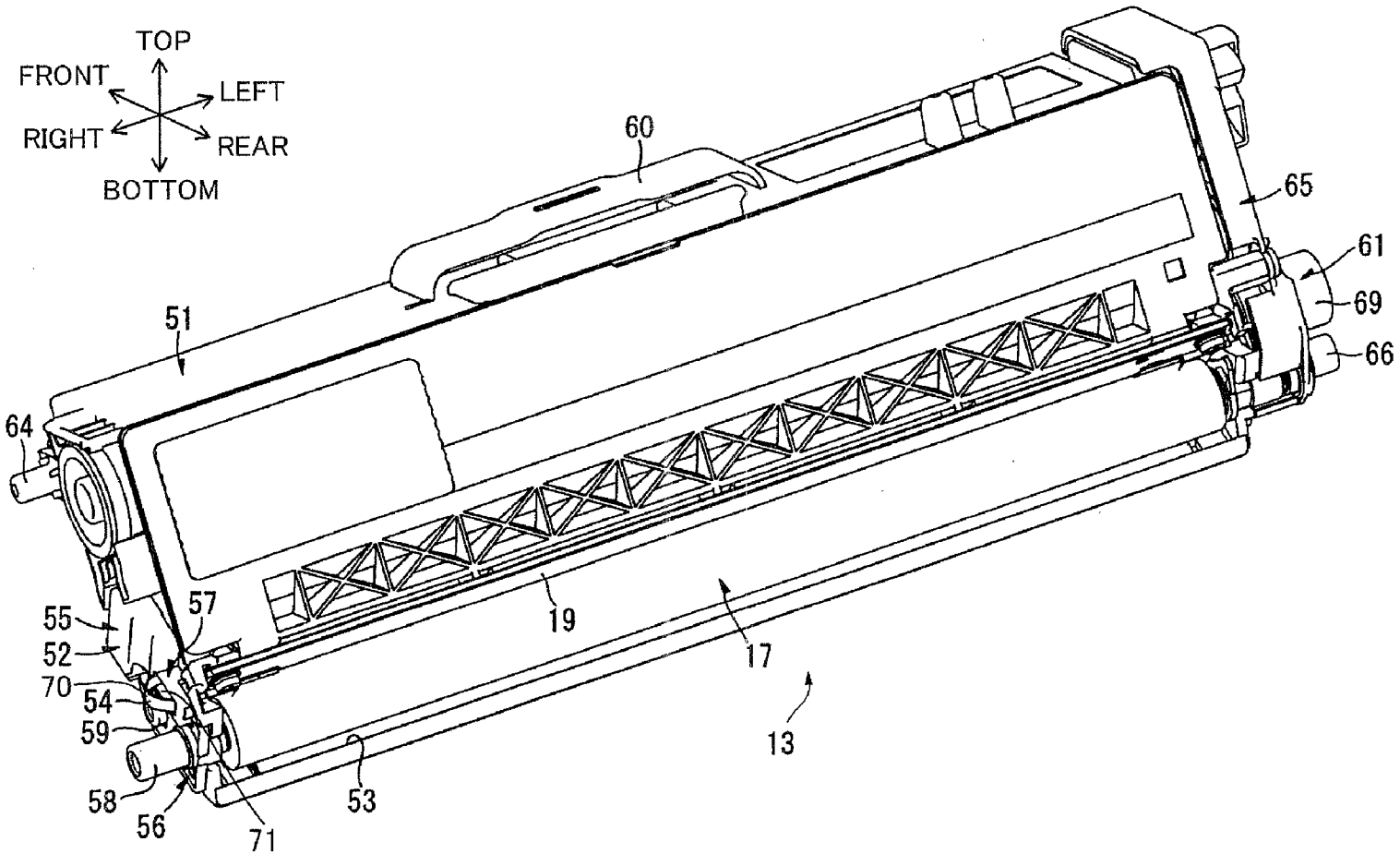
FIG. 4 is a perspective view of a developing cartridge shown in FIG. 1, as viewed from a right rear side thereof.
Figure 5:
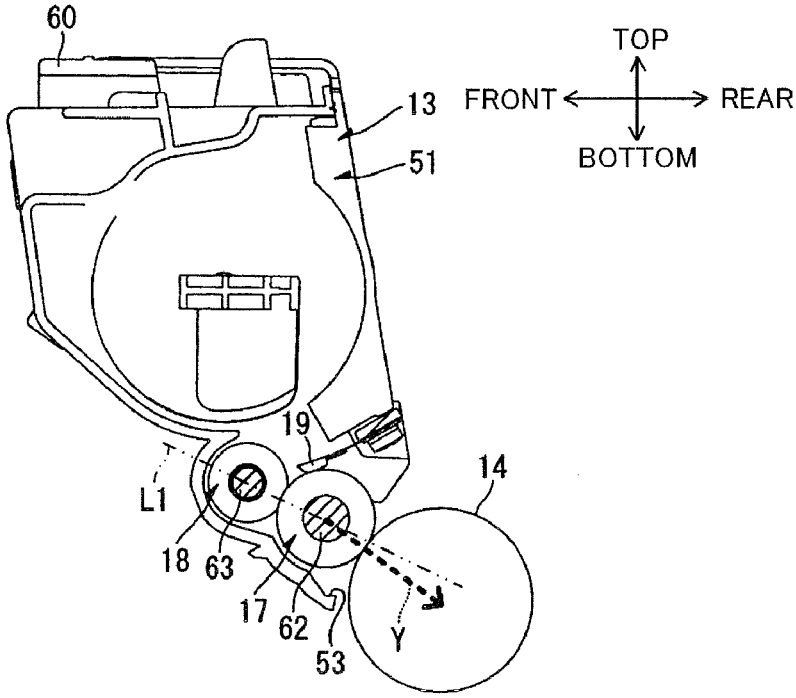
FIG. 5 is a schematic cross-sectional view of the developing cartridge mounted in the process unit.

As shown in FIGS. 4 and 5, the developing cartridge 13 includes a frame 51, the developing roller 17, and the supply roller 18.

The frame 51 is formed in a substantially isosceles triangle shape in a side view having an apex angle located at lower rear portion of the frame 51. The frame 51 is elongated in the left-to-right direction.

The frame 51 has a handle 60 and a pair of left and right bosses 64 at its upper front side. The frame 51 is formed with an opening 53 at its lower rear side.

The handle 60 is so configured as to extend in the left-to-right direction and to protrude upward from a top surface of the frame 51.

The bosses 64 are formed in a substantially cylindrical shape, and protrude laterally outwardly from left and right endfaces of the frame 51.

The opening 53 is formed so as to open in a direction rearward along the entire lower rear side of the frame 51.

Figure 6:
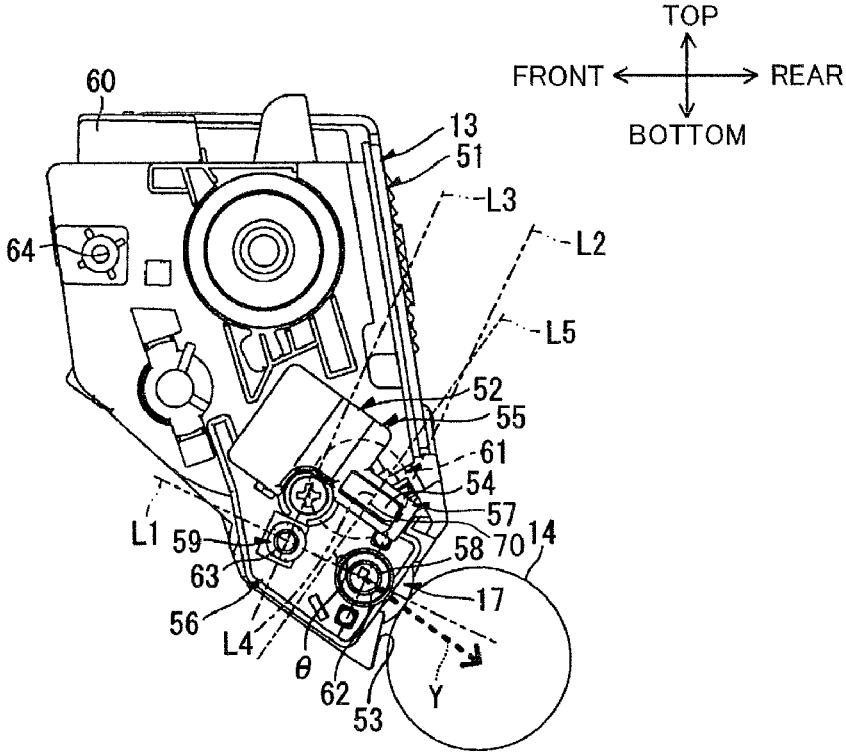
FIG. 6 is a schematic right side view of the developing cartridge mounted in the process unit.

The frame 51 includes an electrode unit 52 and a drive unit 65. As shown in FIGS. 4, and 6, the electrode unit 52 is provided at the right endface of the frame 51. The electrode unit 52 includes the electrode plate 54, as an example of an electrode member, and a unit casing 55.

The electrode plate 54 is a leaf spring formed of electrically conductive material, such as metal. The electrode plate 54 extends diagonally below and rearward, and is bent into a substantially U-shape in a plan view so that an apex of the U-shape protrudes rightward. The apex of the U-shaped electrode plate 54 forms a ridge line L4 extending diagonally below and frontward. That is, the ridge line L4 is perpendicular to the extending direction of the electrode plate 54. Further, the electrode plate 54 has the contact portion 70 at its apex.

The contact portion 70 constitutes a part of the electrode plate 54 that is brought into contact with the process-frame electrode 46 of the process frame 12 when the developing cartridge 13 is mounted in the process unit 9. The contact portion 70 has a linear shape extending along the ridge line L4 of the electrode plate 54. That is, the ridge line L4 lies in the contact portion 70.

The unit casing 55 is integrally provided with a bearing section 56 and an electrode retaining portion 57.

The bearing section 56 has a flat plate shape that is substantially rectangular in a side view. The bearing section 56 is integrally provided with a first bearing portion 58 and a second bearing portion 59.

The first bearing portion 58 is disposed at a rear end portion of the unit casing 55 (shown in FIG. 4), and is formed in a cylindrical shape protruding rightward from the unit casing 55.

The second bearing portion 59 is provided at a position diagonally above and frontward of the first bearing portion 58. The first bearing portion 58 and the second bearing portion 59 are juxtaposed with but spaced apart from each other. The second bearing portion 59 is formed in a cylindrical shape having a diameter smaller than that of the first bearing portion 58. The second bearing portion 59 protrudes rightward from the unit casing 55.

The electrode retaining portion 57 is disposed above the shaft receiving section 56 and retains the electrode plate 54. More specifically, the electrode retaining portion 57 is disposed above the first bearing portion 58. The electrode retaining portion 57 is formed in a substantially rectangular shape in a side view and extends in the front-to-rear direction. The electrode retaining portion 57 is formed with an engagement hole 71.

The engagement hole 71 is formed in a substantially rectangular shape in a side view extending diagonally below and rearward. The engagement hole 71 allows the electrode plate 54 inserting therethrough for retaining the same.

As shown in FIGS. 3 and 4, the drive unit 65 is provided at the left endface of the frame 51. The drive unit 65 includes a coupling portion 61, a third bearing portion 66, and a fourth bearing portion 67.

The coupling portion 61 includes a coupling cover 69 and a coupling member 68 as an example of a drive force receiving member.

The coupling cover 69 is disposed at a lower end portion of the developing cartridge 13. The coupling cover 69 is formed in a cylindrical shape protruding leftward from a left surface of the drive unit 65. As shown in FIG. 6, the coupling cover 69 is arranged to overlap with the electrode plate 54 in the left-to-right direction. In other wards, the coupling cover 69 and the electrode plate 54 are linearly aligned in the left-to-right direction.

The coupling member 68 is a coupling female member having a substantially cylindrical shape. The coupling member 68 is rotatably supported in the coupling cover 69. The coupling member 68 has a left end that is coupled to a coupling male member (not shown) provided at the main casing 2 from the left when the developing cartridge 13 is mounted in the main casing 2. A drive source (not shown) of the main casing 2 inputs a drive force to the coupling member 68. The coupling member 68 transmits the drive force to the developing roller 17 and the supply roller 18 via a gear train (not shown) within the drive unit 65.

The third bearing portion 66 is disposed below the coupling portion 61. The third bearing portion 66 is formed in a substantially cylindrical shape protruding leftward from the left surface of the drive unit 65.

The fourth bearing portion 67 is provided at a position diagonally above and frontward of the third bearing portion 66. The third bearing portion 66 and the fourth bearing portion 67 are juxtaposed with but spaced apart from each other. The fourth bearing portion 67 is formed in a substantially annular shape in a side view having a diameter smaller than that of the third shaft receiving portion 66.

As shown in FIG. 5, the developing roller 17 is disposed at a lower portion of the frame 51, extending in the left-to-right direction. The bottom rear edge of the developing roller 17 is exposed to the atmosphere through the opening 53. Further, the developing roller 17 includes the developing roller shaft 62. The developing roller shaft 62 is an axis of the developing roller 17, and is inserted through the developing roller 17 in the left-to-right direction.

The supply roller 18 is disposed diagonally above and frontward of the developing roller 17. A bottom rear edge of the supply roller 18 contacts the developing roller 17. The supply roller 18 includes a supply roller shaft 63. The supply roller shaft 63 is an axis of the supply roller 18, and is inserted through the supply roller 18 in the left-to-right direction.

The developing roller shaft 62 has left and right ends, and the left end is rotatably supported by the third bearing portion 66 of the drive unit 65 while the right end is rotatably supported by the first bearing portion 58 of the electrode unit 52. Hence, the developing roller 17 is rotatably supported to the frame 51.

Further, the supply roller shaft 63 has left and right ends, and the left end is rotatably supported by the fourth bearing portion 67 of the drive unit 65 while the right end is rotatably supported by the second bearing portion 59 of the electrode unit 52. Hence, the supply roller 18 is rotatably supported to the frame 51.

As shown in FIG. 6, the electrode plate 54 is disposed between a second plane L2 and a third plane L3 at a position above a first plane L1 when projected in the left-to-right direction. Both of an axis of the developing roller shaft 62 and an axis of the supply roller shaft 63 lie in the first plane L1. The second plane L2 is perpendicular to the first plane L1 and the axis of the developing roller 17 lies in the second plane L2. The third plane L3 is perpendicular to the first plane L1 and the axis of the supply roller 18 lies in the tired plane L3.

Further, the contact portion 70 is disposed such that the first plane L1 intersects with an imaginary plane L5. The imaginary plane L5 extends parallel to the axis of the developing roller 17, and the ridge line L4 lies in the imaginary plane L5. In other wards, the imaginary plane L5 includes the ridge line L4. An angle θ (an acute angle) formed by intersecting the first plane L1 with the imaginary plane L5 is set to, for example, an angle between 45 degrees and 90 degrees, preferably an angle between 60 degrees and 90 degrees, and more preferably an angle between 75 degrees and 90 degrees.

3. Mounting of Developing Cartridges in Main Casing (1) Mounting/Removing of Developing Cartridge in/from Process Unit In order to mount the developing cartridge 13 in the main casing 2, the developing cartridge 13 is initially mounted in the process frame 12, as shown in FIGS. 2 and 3.

When the developing cartridge 13 is mounted in the process frame 12, a user initially holds the handle 60 of the developing cartridge 13 to place the developing cartridge 13 at a position above the process frame 12 which has been pulled out from the main casing 2 and a position in conformance with a position of the corresponding photosensitive drum 14 in the front-to-rear direction. Next, the user inserts the developing cartridge 13 down into the process frame 12 from the bottom thereof.

As the developing cartridge 13 is being inserted into the process frame 12, the left and right ends of the developing roller shaft 62 (the first bearing portion 58 and the third bearing portion 66) are brought into engagement with the corresponding first guide grooves 32A of the guide grooves 32 in the side plates 31 (31R and 31L) of the process frame 12 from above. That is, the left end of the developing roller shaft 62 (the third bearing portion 66) is brought into engagement with the first guide groove 32A formed in the left side plate 31L from above, and the right end of the developing roller shaft 62 (the first bearing portion 58) is brought into engagement with the first guide groove 32A formed in the right side plate 31R from above.

While both the left and right ends of the developing roller shaft 62 are guided by the first guide grooves 32A of the guide grooves 32, the developing cartridge 13 is inserted into the process frame 12 along the first direction X so as to be directed slightly rearward as the developing cartridge 13 moves downward.

After both the left and right ends of the developing roller shaft 62 have reached the lower end sections of the first guide grooves 32A of the guide grooves 32, the user continuously inserts the developing cartridge 13 further down into the process frame 12.

While guided by the corresponding second guide grooves 32B of the guide grooves 32, both the left and right ends of the developing roller shaft 62 are moved in the second direction Y to reach lowermost sections of the second guide grooves 32B.

At this time, each of the bosses 64 contacts the arcuate portion 39 of the pressing cam 36 from above. Then, each of the bosses 64 presses the arcuate portion 39 from above to pivotally move the pressing cam 36 frontward about the pivot shaft 40 (in the clockwise direction in FIG. 3) against an urging force of the urging member (not shown) while the developing cartridge 13 is pivotally moved frontward about the developing roller shaft 62.

When both the left and right ends of the developing roller shaft 62 are moved in the second direction Y to reach lowermost sections of the second guide grooves 32B, each boss 64 is positioned below the rear flat portion 38 of the pressing cam 36 and is in confrontation with and away from the separating portion 44 as indicated by dotted lines in FIG. 3. Hence, the pressing cam 36 is brought into engagement with the boss 64 from above, and presses the boss 64 rearward and downward by the urging force of the urging member (not shown). That is, the developing cartridge 13 is pressed rearward and downward by the pressing cams 36.

At this time, the developing cartridge 13 is pressed rearward and downward by the pressing cams 36, and the developing roller shaft 62 is guided by the second guide grooves 32B of the side plates 31. Therefore, the developing cartridge 13 is moved rearward and downward in the second direction Y and brought into pressure contact with the corresponding photosensitive drum 14. Hence, the developing cartridge 13 is completely mounted relative to the process frame 12. In the same manner as described above, all the developing cartridges 13 are mounted in the process frame 12.

When the developing cartridge 13 is mounted in the process frame 12, as shown in FIG. 5, the developing roller 17 is brought into contact with the photosensitive drum 14 at a position opposite the supply roller 18. The first plane L1 in which the axes of the developing roller shaft 62 and the supply roller shaft 63 lie is substantially parallel to the second direction Y. That is, a direction that the developing roller 17 contacts the supply roller 18 (a direction from the axis of the supply roller shaft 63 to the axis of the developing roller shaft 62) is substantially the same as a direction that the developing roller 17 contacts the photosensitive drum 14 (the second direction Y).

Further, as shown in FIG. 6, the ridge line L4 of the electrode plate 54 is substantially perpendicular to the second direction Y.

Figure 7:
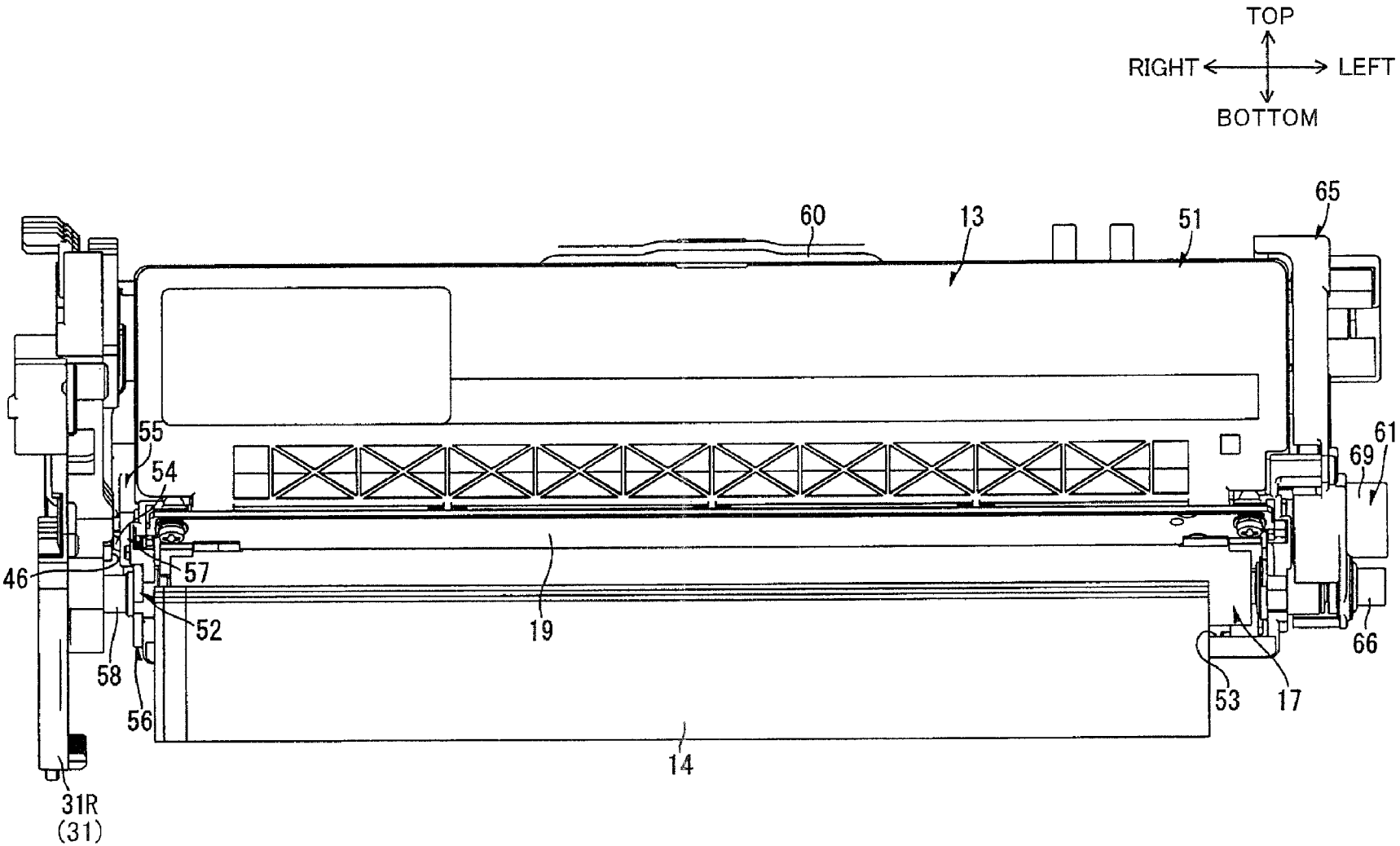
FIG. 7 is an explanatory view for explaining electrical connection between the developing cartridge and the right side plate of the process frame.

As shown in FIG. 7, the electrode plate 54 of the developing cartridge 13 is brought into contact with the process-frame electrode 46 of the right side plate 31R from the left.

When the developing cartridge 13 is removed from the process frame 12, the user operates the developing cartridges 13 in a manner the reverse of what the user mounts the developing cartridge 13 in the process frame 12.

That is, the user holds the handle 60, and then, pivotally moves the developing cartridge 13 rearward. Subsequently, with holding the handle 60, the user pulls the developing cartridge 13 upward to remove the developing cartridge 13 from the process frame 12.

(2) Mounting/Removing of Process Unit in/from Main Casing

Next, the user mounts the process unit 9, that is, the process frame 12 in which all the developing cartridges 13 are mounted, in the main casing 2. In order to mount the process unit 9 in the main casing 2, the user moves the process unit 9 rearward to insert the same into the main casing 2.

As shown in FIG. 1, when the process unit 9 is entirely inserted into the main casing 2, each photosensitive drum 14 is brought into contact with the upper section of the conveying belt 22. The user then pivotally moves the front cover 5 rearward, so that the inner space of the main casing 2 is closed by the front cover 5.

Hence, the process unit 9 has been mounted in the main casing 2.

Further, when the process unit 9 mounted in the main casing 2 is removed from the main casing 2, the user pivotally moves the front cover 5 frontward to pull out the process unit 9 frontward from the main casing 2.

(3) Power Supply

When the developing cartridges 13 mounted in the process frame 12 are mounted in the main casing 2, electrical power is supplied from a power source (not shown) of the main casing 2 to the power receiving section (not shown) of the process-frame electrode 46. When the power receiving section of the process-frame electrode 46 receives electric power, the process-frame electrode 46 supplies the electric power to the electrode plate 54.

When the electrode plate 54 receives electric power, the electrode plate 54 supplies the electric power to the developing roller shaft 62 and the supply roller shaft 63 via a cable (not shown) in the electrode unit 52. Hence, a bias is simultaneously and equally applied to the developing roller 17 and the supply roller 18.

4. Movements of Developing Cartridge relative to Photosensitive Drum for Contact and Separation Movements of the developing cartridge 13 relative to the photosensitive drum 14 when the developing cartridge 13 is brought into contact with or separated from the corresponding photosensitive drum 14 will hereinafter be described while referring to FIG. 3.

The color laser printer 1 is capable of switching between a color mode for forming a color image and a monochrome mode for forming a black and white image. In the color mode, as described above, all the developing cartridges 13 are in contact with their respective photosensitive drums 14. In the monochrome mode, although it is not shown, the non-black developing cartridges 13 (the yellow developing cartridge 13Y, the magenta developing cartridge 13M and the cyan developing cartridge 13C) are separated from their respective non-black photosensitive drums 14 (the yellow photosensitive drum 14Y, the magenta photosensitive drum 14M, and the cyan photosensitive drum 14C), while the black developing cartridge 13K is in contact with the black photosensitive drum 14K.

In order to separate the developing cartridge 13 from the photosensitive drum 14, the protruding portions 47 of the separating cams 37 corresponding to the developing cartridge 13 to be separated from the photosensitive drum 14 is pressed by a translation cam mechanism (not shown) provided in the main casing 2. Upon pressing the protruding portions 47, the separating cams 37 are pivotally moved about the axis of the pivot shaft 45 in the counterclockwise direction in a left side view against the urging force of the urging member (not shown).

Pivotal movement of the separating cams 37 pivotally moves the separating portions 44 about the axis of the pivot shaft 45 diagonally upward and frontward. Pivotal movement of the separating portions 44 presses the bosses 64 of the developing cartridge 13 diagonally upward and frontward.

At this time, the bosses 64 of the developing cartridge 13 press the pressing cams 36 upward from below, while the separating cams 37 press the bosses 64 diagonally upward and frontward. With this movement, the developing cartridge 13 is lifted diagonally upward and frontward. At the same time, the developing roller shaft 62 is guided by the second guide grooves 32B of the side plates 31 so as to be moved diagonally upward and frontward in the second direction Y. Hence, the developing cartridge 13 is separated from the photosensitive drum 14.

In order to bring the developing cartridge 13 separated from the photosensitive drum 14 into contact with the photosensitive drum 14 again, the protruding portions 47 of the separating cams 37 are released from the pressing force by the translation cam mechanism. Accordingly, the bosses 64 of the developing cartridge 13 are again pressed by the pressing cams 36, as described above.

The developing roller shaft 62 is guided by the second guide grooves 32B of the side plates 31, and therefore, the developing cartridge 13 is brought into pressure contact with the photosensitive drum 14 diagonally downward and rearward in the second direction Y.

Further, while the developing cartridge 13 is in contact with or separated from the photosensitive drum 14, the process-frame electrode 46 of the process frame 12 is constantly placed in contact with the entire portion of the contact portion 70 of the electrode plate 54 of the developing cartridge 13.

5. Effect (1) According to the developing cartridge 13, as shown in FIG. 6, the electrode plate 54 has the linear contact portion 70 which is brought into contact with the process-frame electrode 46. The contact portion 70 of the electrode plate 54 is located at a position that the first plane L1 intersects with the imaginary plane L5 at an angle between 45 degrees and 90 degrees. Both of the axis of the developing roller shaft 62 and the axis of the supply roller shaft 63 lie in the first plane L1. The imaginary plane L5 extends parallel to the axis of the developing roller 17, and the ridge line L4 lies in the imaginary plane L5.

Therefore, compared with a case where the contact portion 70 is provided so as to extend substantially parallel to the first plane L1, the contact portion 70 can be downsized in a direction in which the first plane L1 extends (that is, a direction from the axis of the developing roller 17 to the axis of the supply roller 18). Accordingly, in the direction in which the first plane L1 extends, downsizing of the process-frame electrode 46 which is brought into contact with the contact portion 70 can also be attained.

In particular, in the process unit 9, the developing cartridge 13 is mounted in the process frame 12 such that the developing roller 17 is brought into contact with the photosensitive drum 14 at a position opposite the supply roller 18. That is, the developing roller 17, the supply roller 18 and the photosensitive drum 14 are substantially linearly aligned, and the direction from the axis of the developing roller 17 to the axis of the photosensitive drum 14 (i.e. the second direction Y) is substantially parallel to the direction from the axis of the supply roller 18 to the axis of the developing roller 17 (along the first plane L1). Hence, in the direction from the axis of the developing roller 17 to the axis of the photosensitive drum 14 (i.e. the second direction Y), the process-frame electrode 46 can be downsized.

Downsizing of the process-frame electrode 46 can prevent the process-frame electrode 46 from interfering the developing cartridge 13 when the developing cartridge 13 is mounted in the process frame 12. Accordingly, mounting operation for the developing cartridge 13 in the process frame 12 can be improved.

(2) Further, according to the developing cartridge 13, as shown in FIG. 6, the electrode plate 54 is provided at a position between the second plane L2 and the third plane L3. The second plane L2 is perpendicular to the first plane L1 and the axis of the developing roller shaft 62 lies in the second plane L2. The third plane L3 is perpendicular to the first plane L1 and the axis of the supply roller shaft 63 lies in the third plane L3.

Thus, the process-frame electrode 46 can be positioned at a downstream side of the guide groove 32 of the process frame 12 in the direction that the developing cartridge 13 is mounted in process frame 12 (i.e. the second direction Y).

In the process unit 9, the developing cartridge 13 is mounted in the process frame 12 such that the developing roller 17 is placed into contact with the photosensitive drum 14 at a position opposite the supply roller 18. Positioning of the process-frame electrode 46 at the downstream side of the guide groove 32 can further prevent the process-frame electrode 46 from interfering the developing cartridge 13 when the developing cartridge 13 is mounted in the process frame 12. Accordingly, the mounting operation of the developing cartridge 13 in the process frame 12 can be improved further.

(3) Further, according to the developing cartridge 13, the electrode plate 54 is formed of leaf spring. Hence, with a simple structure, the electrode plate 54 can be brought into resilient contact with the process-frame electrode 46. Accordingly, the electrode plate 54 can be brought into contact with the process-frame electrode 46 stably.

(4) Further, according to the developing cartridge 13, as shown in FIGS. 4 and 6, the coupling member 68 into which the drive force is inputted from the main casing 2 is provided at the left endface of the developing cartridge 13 and is arranged to overlap with the electrode plate 54 in the left-to-right direction.

Since the developing cartridge 13 is pressed rightward when the drive force is inputted into the left end of the coupling member 68 by the coupling male member (not shown), the electrode plate 54 can be pressed toward the process-frame electrode 46 by the pressing force. Consequently, the electrode plate 54 can be brought into contact with the process-frame electrode 46 more stably.

(5) Further, according to the developing cartridge 13, as shown in FIG. 4, the electrode plate 54 is formed in a curved shape so as to protrude rightward from the right end of the frame 51.

Hence, such a simple arrangement that the electrode plate 54 is bent into a curved shape can facilitate protruding the electrode plate 54 rightward and bring the electrode plate 54 into reliable contact with the process-frame electrode 46.

Further, the contact portion 70 includes the ridge line L4. The imaginary plane L5 including the ridge line L4 intersects with the first plane L1 at an angle between 45 degrees and 90 degrees. Compared to a case where the contact portion 70 is provided to include a ridge line extending in a direction substantially parallel to the first plane L1, the contact portion 70 can be downsized in the direction to which the first plane L1 extends (that is, the direction from the axis of the supply roller 18 to the axis of the developing roller 17).

Further, in the process unit 9, the developing cartridge 13 is mounted in the process frame 12 such that the developing roller 17 is brought into contact with the photosensitive drum 14 at a position opposite the supply roller 18 in the direction from the axis of the supply roller 18 to the axis of the developing roller 17. Accordingly, the process-frame electrode 46 which is brought into contact with the contact portion 70 can be downsized.

While the present invention has been described in detail with reference to the embodiment thereof, it would be apparent to those skilled in the art that various changes and modifications may be made therein without departing from the spirit of the invention.

What is claimed is:

1. A developing cartridge comprising:

a frame;

a developer carrying member that is rotatably supported on the frame and carries a developer, the developer carrying member having a first rotational axis defining an axial direction;

a developer supplying member that is rotatably supported on the frame and contacts the developer carrying member to supply the developer to the developer carrying member, the developer supplying member having a second rotational axis parallel to the first rotational axis, both of the first rotational axis and the second rotational axis lying in a first plane; and an electrode member that is provided on the frame, the electrode member having a U-shape and forming a ridge line, the electrode member being configured to receive an electrical power from an external power supplying member, the electrode member having a contact portion that is configured to contact with the external power supplying member, the contact portion having a linear shape and lying in an imaginary plane that extends parallel to the first rotational axis, the contact portion being at an apex of the U-shape of the electrode member, the first plane intersecting with the imaginary plane at an angle between 45 degrees and 90 degrees, the imaginary plane including the ridge line.

2. The developing cartridge according to claim 1, wherein the electrode member is positioned between a second plane and a third plane, the second plane being perpendicular to the first plane, the first rotational axis lying in the second plane, the third plane being perpendicular to the first plane, the second rotational axis lying in the third plane.

3. The developing cartridge according to claim 1, wherein the electrode member is a leaf spring.

4. The developing cartridge according to claim 1, further comprising a drive force receiving member into which a drive force is inputted from a main casing of an image forming apparatus, the drive force being transmitted from the drive force receiving member to the developer carrying member and the developer supplying member, the frame having one end portion and another end portion in the axial direction, the electrode member being provided on the one end portion, the drive force receiving member being provided on the another end portion, the electrode member being arranged to overlap with the drive force receiving member in the axial direction.

5. The developing cartridge according to claim 4, wherein the one end portion of the frame has one end surface and another end surface in the axial direction, the developer carrying member and the developer supplying member being provided at the one end surface side, the electrode member being provided at the another end surface side, and wherein the electrode member is bent into a curved shape so as to protrude from the another end surface in the axial direction, and the contact portion is located at an apex of the electrode member and includes a ridge line that lies in the imaginary plane.

6. A process unit comprising:

a process frame that is slidingly movable relative to the main casing of an image forming apparatus; and a developing cartridge that is detachable from or attachable to the process frame, the developing cartridge comprising:

a frame;

a developer carrying member that is rotatably supported on the frame and carries a developer, the developer carrying member having a first rotational axis defining an axial direction;

a developer supplying member that is rotatably supported on the frame and contacts the developer carrying member to supply the developer to the developer carrying member, the developer supplying member having a second rotational axis parallel to the first rotational axis, both of the first rotational axis and the second rotational axis lying in a first plane; and an electrode member that is provided on the frame, the electrode member having a U-shape and forming a ridge, the electrode member being configured to receive an electrical power from an external power supplying member, the electrode member having a contact portion that is configured to contact with the external power supplying member, the contact portion having a linear shape and lying in an imaginary plane that extends parallel to the first rotational axis, the contact portion being at an apex of the U-shape of the electrode member, the first plane intersecting with the imaginary plane at an angle between 45 degrees and 90 degrees, the imaginary plane including the ridge line.

7. An image forming apparatus comprising:

a main casing; and a process unit that is accommodated in the main casing, the process unit comprising:

a process frame that is slidingly movable relative to the main casing; and a developing cartridge that is detachable from or attachable to the process frame, the developing cartridge comprising:

a frame;

a developer carrying member that is rotatably supported on the frame and carries a developer, the developer carrying member having a first rotational axis defining an axial direction;

a developer supplying member that is rotatably supported on the frame and contacts the developer carrying member to supply the developer to the developer carrying member, the developer supplying member having a second rotational axis parallel to the first rotational axis, both of the first rotational axis and the second rotational axis lying in a first plane; and an electrode member that is provided on the frame, the electrode member having a U-shape and forming a ridge, the electrode member being configured to receive an electrical power from an external power supplying member, the electrode member having a contact portion that is configured to contact with the external power supplying member, the contact portion having a linear shape and lying in an imaginary plane that extends parallel to the first rotational axis, the contact portion being at an apex of the U-shape of the electrode member, the first plane intersecting with the imaginary plane at an angle between 45 degrees and 90 degrees, the imaginary plane including the ridge line.

* * * * *